United States Patent [19]

Nakamura

[11] Patent Number: 4,840,053

[45] Date of Patent: Jun. 20, 1989

[54] METHOD FOR MANUFACTURING A PIPE WITH PROJECTIONS

[75] Inventor: Masanobu Nakamura, Kamakura, Japan

[73] Assignees: Mitsui & Co., Ltd., Tokyo; Kokan Kako Co., Ltd., Yokohama, both of Japan

[21] Appl. No.: 139,811

[22] Filed: Dec. 30, 1987

[30] Foreign Application Priority Data

Jul. 29, 1987 [JP] Japan ..... 62-189384
Aug. 17, 1987 [JP] Japan ..... 62-203841

[51] Int. Cl.[4] ..... B21D 26/02

[52] U.S. Cl. ..... 72/58; 72/61; 72/62; 72/54; 29/421.1

[58] Field of Search ..... 72/58, 59, 61, 62, 54; 29/421 R

[56] References Cited

U.S. PATENT DOCUMENTS 2,372,917 4/1945 Tuttle ..... 72/62
2,960,142 11/1960 Cimochowski ..... 72/59

FOREIGN PATENT DOCUMENTS 46709 9/1967 Japan ..... 72/62
206530 12/1982 Japan ..... 72/61
772134 4/1957 United Kingdom ..... 72/62

*Primary Examiner*—David Jones
*Attorney, Agent, or Firm*—Spencer & Frank

[57] ABSTRACT

A method for forming branch pipes on the periphery of a pipe, such as a manifold for automobiles, is characterized in that the branch pipes are formed by a bulging process to have a predetermined thickness without thinning. A first embodiment includes the step of indenting a pipe member by press work or the like, at locations close to the position of a projection, in a preliminary deforming process. A second embodiment employs a bulge mold having fixed spaces and variable spaces for forming a plurality of projections. The second embodiment includes the step of bulging the pipe material into the fixed spaces while the variable spaces are occupied by detachable members, and the step of removing the detachable members from the mold and then bulging the pipe member again.

11 Claims, 4 Drawing Sheets

METHOD FOR MANUFACTURING A PIPE WITH PROJECTIONS

BACKGROUND OF THE INVENTION

This invention relates to a manufacturing method for pipes having branched pipes, such as manifolds.

Pipe members having branch pipes on the periphery thereof are often used to connect other pipes or devices to each other.

A known method for manufacturing a pipe with branch pipes of this type comprises the step of opening holes on the peripheral surface of a pipe member, and connecting other pipe members at their ends over the holes by welding. But this method needs much labour for welding, especially when the number of branch pipes is larger as in the case of a manifold, and moreover, the strength of the pipe member is susceptible to deterioration owing to the heat during the welding process.

In order to overcome such defects, a bulging process has been employed for forming a pipe having branch pipes in recent years.

The bulging process comprises the steps of inserting a pipe member into a bulge mold which has recesses or spaces for forming bulges, pressurizing fluid (such as water) into the pipe member to deform and bulge the material of the pipe member into spaces in the bulge mold, forming projections from the peripheral surface of the pipe material, and forming the branch pipes either by cutting the tip ends of the projections or opening holes thereon.

However, the aforementioned bulging process is detrimental in that when the length or diameter of a branch pipe is large, the thickness thereof becomes insufficient since the bulged portioin or the projection has been made with material gathered around the location. The strength of the pipe therefore is not sufficient.

Further, although one or two projections may be formed with a sufficient thickness even if they are formed with the material gathered from the surrounding areas, when three or more projections are to be formed simultaneously, the material required for the middle projections is prevented from being gathered by two adjacent branch pipes. The thickness of the projection at the middle is inevitably insufficient and presents a problem in the manufacturing process.

SUMMARY OF THE INVENTION

This invention aims at providing a manufacturing method for a pipe with projections, and more particularly to a method which can be employed to manufacture a pipe having projecting portions with a predetermined thickness even if the bulged region (i.e., the region for providing branch pipes) is long.

Another object of this invention is to provide a manufacturing method for a pipe with projections which can gather sufficient material for projections and secure a uniform thickness for the projections even if the number of projections exceeds three.

In order to achieve the first object of this invention, a method for manufacturing a pipe with projections was contrived to have the following steps.

The process comprises the steps of preliminarily deforming a pipe member to make recesses by such means as press work near the locations where the projections are to be formed, inserting the preliminarily deformed pipe member in a bulge mold, pressurizing fluid into the pipe member and bulging the areas near said deformed portions to form projections which are to be formed as branch pipes. Because the pipe member is preliminarily deformed to have recesses thereon, additional pipe material is gathered or folded in the vicinity of the recesses. When the pipe member is subsequently bulged, the gathered excess material is pulled in to the projected bulges to give them sufficient thickness.

The second object of this invention can be achieved by the following manufacturing method for a pipe with projections.

The process is characterized by the use of a bulge mold which has a fixed recess or space provided at an axially intermediate portion of a bulge mold, variable spaces at the sides of said fixed space (or spaces), and detachable members removably mounted in said variable spaces in a manner so as to occupy each variable space fully.

Operation of the process will now be described. A pipe member is placed in a bulge mold where detachable members have already been mounted in the variable spaces. A highly pressurized fluid is forced into the pipe member, and the pipe member is pressed from both ends simultaneously to bulge an intermediate portion thereof. Then the detachable members are pulled out from the bulge mold to use the variable spaces as the spaces for bulging. Highly pressurized fluid is again forced into the pipe member and the pipe member is pressed from both ends of the mold to bulge the material of the pipe member toward outside.

Since this embodiment of the method of the invention bulges the middle portion of a pipe member when the variable spaces are filled with the detachable members, sufficient pipe material is gathered and folded in the middle portion to provide projections having sufficient thickness. Projections closer to ends of the pipe member are formed after the completion of the middle projection, so that a sufficient thickness for the branch pipes is guaranteed at all the bulged projections.

BRIEF DESCRIPTION OF THE DRAWINGS

FIG. 1 is a perspective view showing a pipe member which has been preliminarily deformed;

FIG. 2 is a cross section of the pipe member at the portion deformed;

FIG. 3 is a cross section showing the state of the pipe member of FIG. 1 when it is contained in a bulge mold;

FIG. 4 is a cross section showing the state after bulging;

FIG. 5 is a perspective view showing the pipe member after the completion of forming process;

FIG. 6 is a cross section showing the pipe member sectioned at the projected portion;

FIG. 7 is a perspective view showing a pipe member which has been deformed preliminarily to have a bulge by the bulging process; and FIG. 8 is a cross section showing the preliminarily deformed pipe material.

FIGS. 9 through 13 show a second embodiment according to the invention.

FIG. 9 is a cross section showing a pipe member which has been formed to have projections at the middle portion thereof;

FIG. 10 is a cross section showing the state of the pipe member when the projections closer to the ends of the pipe member have been formed;

FIG. 13 is a perspective view showing a completed pipe having projections formed with the embodiment shown in FIG. 9.

DETAILED DESCRIPTION OF THE PREFERRED EMBODIMENT

This invention will now be described in further detail referring to embodiments shown in drawings.

Figure 1:
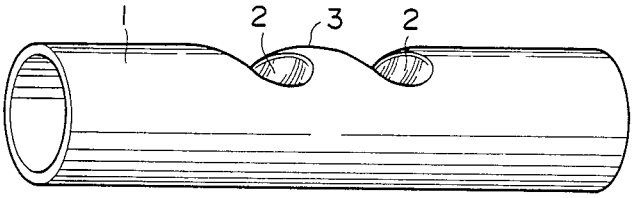
FIGS. 1 through 8 relate to a first embodiment according to the invention.
Figure 2:
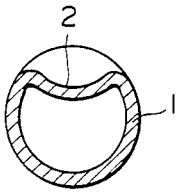

The reference numeral 1 in FIGS. 1 and 2 denotes a pipe member which has preliminarily deformed portions 2,2 in the form of recesses produced by a press at two locations near the position where a projection is to be formed. The recesses 2 are in alignment in the longitudinal direction of the pipe 1.

Figure 3:
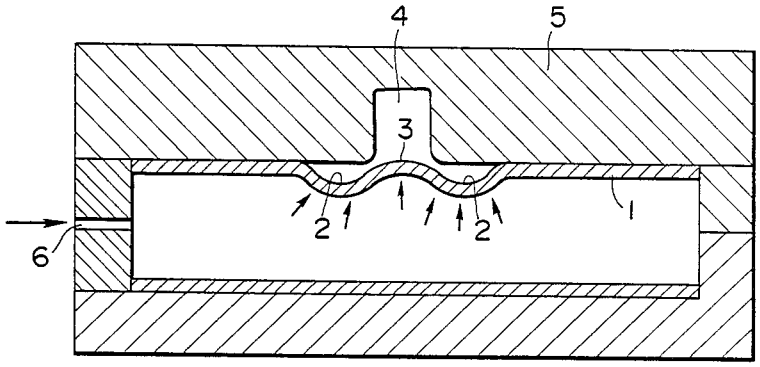

The preliminarily deformed pipe member 1 is placed in a bulge mold 5 in such a manner that the portion 3 having excess folded pipe material between said deformed locations 2,2 is put in a recess or space 4 of the mold reserved for the bulge as shown in FIG. 3.

Subsequently, both ends of the pipe member 1 are sealed, and pressurized fluid (such as water) is forced into the pipe member 1 from an inlet 6 on the bulge mold 5.

Figure 4:
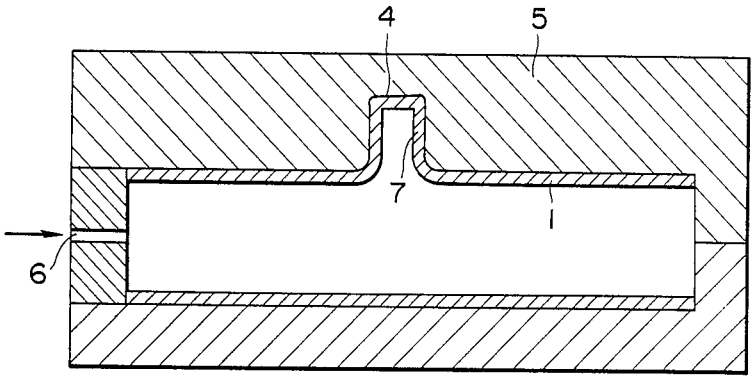
Figure 5:
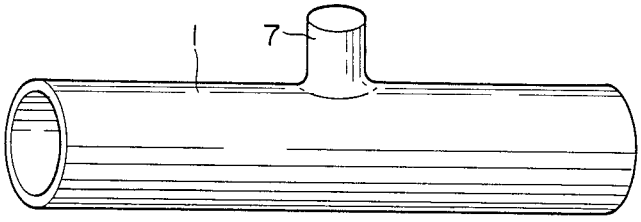
Figure 6:
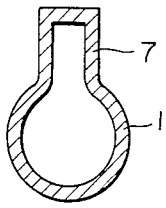

This applies pressure on the internal surfaces of the deformed portions 2,2 and the portion 3 to bulge the portion 3 outward to fill the space 4 inside the mold 5 as shown in FIG. 4. A pipe-like projection 7 is formed from the surface of the pipe member 1 as shown in FIGS. 5 and 6.

The projection 7 is either cut at the end or bored thereon to form a predetermined branch pipe.

When the pipe member 1 is deformed at the positions 2,2 in advance, excess pipe material is gathered sufficiently to sag around the positions. When the pipe member 1 is then bulged into the space 4 within the mold, the sagged portions at the positions 2,2 are extended to form a projection. As a result, when the material is bulged into the space 4 in the mold, the material will not be unduly thinned at the foot of the projection 7, so the thickness of the projection 7 will be sufficient.

Figure 7:
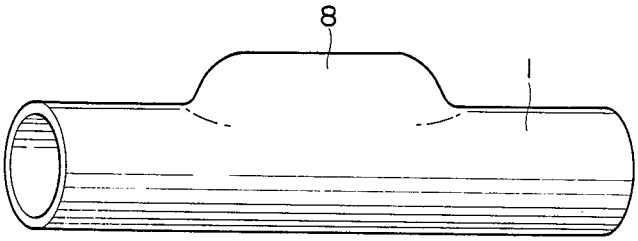
Figure 8:
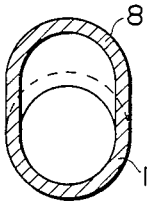

As shown in FIGS. 7 and 8, if a pipe member 1 is bulged for a predetermined length in the longitudinal direction thereof to have a bulged portion 8, and the bulged portion 8 is pressed at two positions at the ends thereof to form deformed positions 2,2 as shown in FIG. 1, additional material is retained for the projection to thereby further facilitate formation of a projection 7.

Although the foregoing discussion concerned a pipe 1 which has only one projection, this method is naturally applicable to a pipe having a large number of branch pipes or projections, such as manifolds.

Figure 12A:
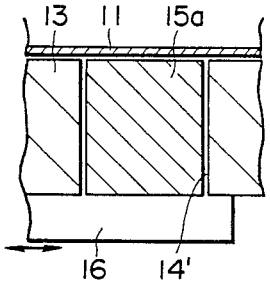
FIGS. 12A and 12B are cross sections showing another modification of the second embodiment.
Figure 12B:
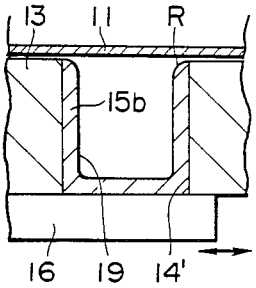
Figure 13:
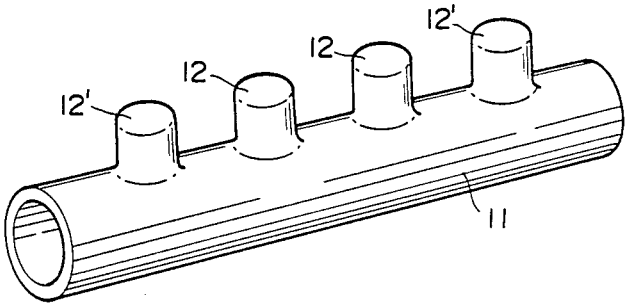

The second embodiment will now be described referring to FIGS. 9 through 13. The embodiment shown in the figures relates to a pipe member 11 having four projections 12,12,12',12' formed axially at predetermined intervals on the peripheral surface thereof. An example of a completed pipe with projections is shown in FIG. 13.

Inside a bulge mold 13, spaces 14,14,14',14' for bulging are provided at the same intervals as the projections 12,12,12',12' which are to be formed on the peripheral surface of the pipe material 11.

The mold spaces 14,14 corresponding to the projections 12,12 at axially middle positions of the pipe member 11 are fixed spaces of a shape identical to that of the projections 12,12.

The mold spaces 14',14' corresponding to the projections 12',12' closer to the ends of the pipe member 11 are "variable" spaces in which detachable members 15,15 are movably mounted to initially occupy the spaces as fully as possible.

Figure 9:
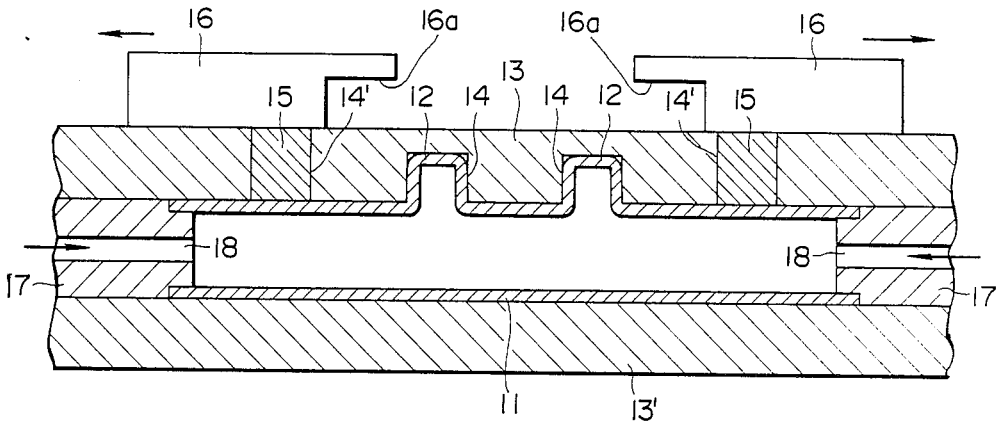
Figure 10:
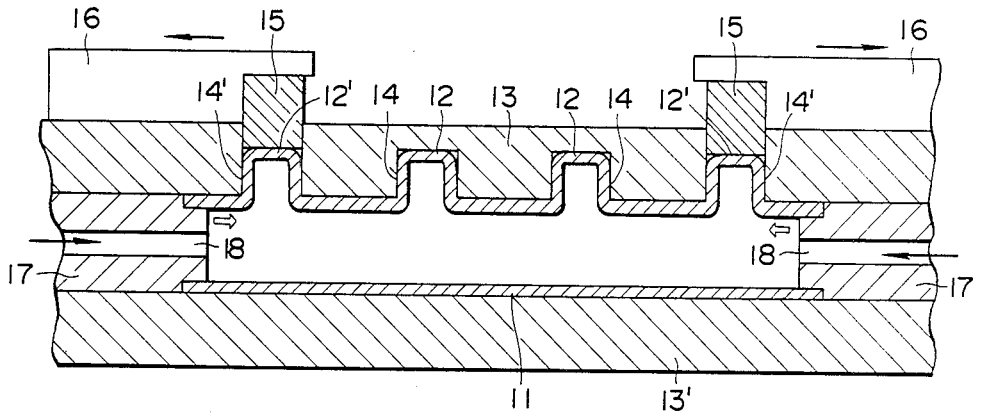

Referring to the embodiment shown in FIGS. 9 and 10, the variable spaces 14',14' at positions closer to ends of the mold 13 are formed as through holes penetrating through the wall of the mold 13, and detachable members 15,15 having a length equal to the thickness of the bulge mold 13 are inserted as closely as possible. Pressing members 16,16 are mounted on the outer surface of the mold 13 in a manner so as to freely slide in parallel to the axial direction of the pipe member 11 placed in the mold 13. When the interfaces of the pressing members 16,16 with the mold 13 restrict the upward movement of the members 15,15, the internal surfaces of the members 15,15 partially define the internal circumference of the bulge mold 13. At both ends of the bulge molds 13,13', holders 17,17 are provided for pressing the pipe member 11 from both ends. Holders 17,17 are penetrated by through holes 18,18 for pressurizing fluid (such as water) in the bulging process.

The holders 17,17 abut on both ends of the pipe member 11, which is housed within a space defined with the bulge molds 13,13', and are pressed from both sides axially by oil pressure or the like so as to fold the material 11.

The pressing members 16,16 are notched at the ends thereof at a height identical to the depth of the fixed spaces 14,14. When the notches **16*a*,16*a* are moved to be immediately above the variable spaces 14',14' by the sliding movement of the pressing members 16,16, the movable members 15,15 may be moved upwardly until they abut on the surfaces of the notches 16*a*,16*a***.

Four projections are formed as follows: A pipe member 11 is placed inside bulge molds 13,13' which are bound by tightening. Holders 17,17 are moved into abutment at both ends of the pipe member 11, and detachable members 15,15 are inserted into the spaces 14',14' and retained by the abutment of pressing members 16,16.

Pressurized fluid is then forced in via through holes 18,18 in the holders 17,17, and the holders are moved under pressure toward the center of the mold. Under the folding effect by the holders 17,17, the pipe material 11 is caused to bulge toward the fixed spaces 14,14 by the pressurized fluid, so as to conform to the shapes thereof. (Refer to FIG. 9).

Since the variable spaces 14',14' are filled with the detachable members 15,15, the material is efficiently and smoothly folded without being disturbed by the spaces 14',14'. After completion of the bulged portions 12,12 at the middle position, the pressing members 16,16 are slided until the notches **16*a*,16*a* are positioned immediately above the spaces 14',14' to release the detachable members 15,15. Then, the pressurized fluid is forced in again via the through holes 18,18, and the pipe material 11 is pressed with the holders 17,17 at both ends thereof. Because the detachable members 15,15 are not retained any more, the internal pressure in the pipe material 11 overcomes the weight of the members 15,15** to cause the material 11 to bulge into the spaces 14',14' due to the folding effect by the holders 17,17.

Since the detachable members 15,15 are restrained by the notches 16a,16a of the members 16,16, bulged portions 12',12' are formed to have the same height as the middle bulges 12,12. (Refer to FIG. 10). As the bulged portions 12',12' are formed under a suitable folding effect at positions closer to the ends of the pipe material 11, the projections are formed to have uniform thickness.

FIGS. 11 and 12 show a modification of this embodiment of the invention to form a projection which is shaped like a bell having a larger diameter at the base thereof.

Figure 11A:
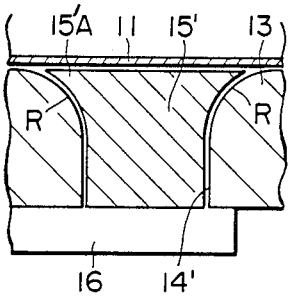
FIGS. 11A and 11B are cross sections showing a modification of the second embodiment with variable spaces and detachable members being flared.

Referring to FIG. 11A, a detachable member 15' has a larger diameter 15'A at its base so as to be accommodated within a space 14' having a divergently curved wall. The member 15' may be pulled out into the mold 13 from the upper surface thereof.

Figure 11B:
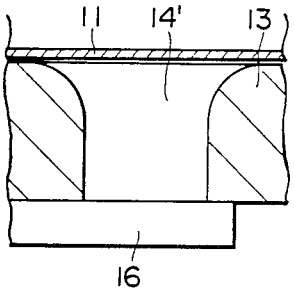

Although the fixed space 14 is not shown, it may be shaped similarly to the variable space 14' shown in FIG. 11B.

However, since the detachable member 15' must be removed into the bulge mold 13, and the pipe member 11 must be removed temporarily from the bulge mold 13 to permit the member 15' to be pulled out. Consequently, this modification is somewhat time consuming In the further modification shown in FIG. 12, the method is improved in order to obviate the trouble of undoing the binding of the bulge molds temporarily and take out the pipe material 11 after the bulged portions are formed in the fixed spaces 14,14. More particularly, an improved bulge mold 13 comprises a first detachable member 15*a* of columner shape as shown in FIG. 12A, and a second detachable member 15*b* as shown in FIG. 12B. The second detachable member 15*b* has a cylindrical shape with a closed end, and the inner edges of the open end are rounded to provide a predetermined diameter and curvature. The members 15*a* and 15*b* are freely insertable into and removable from the space 14'.

First, bulged portions 12,12 at the middle positions are formed when the first detachable columner member 15*a* is retained within the space 14'. Then the first detachable member 15*a* is taken out after the pressing member 16 has been removed. The second detachable member 15*b* is then inserted into the space 14' and retained by pressing member 16 while a bulged portion is formed. The bulged portion 12' conforms to the curvature of the inner surface 19 of the member 15*b* in the mold 13, thereby forming a curved portion at the base of a projection.

Although the foregoing discussion relates to a pipe having four projections, the number of the bulged portions 12,12' to be formed on the pipe member 11 may be determined arbitrarily.

For example, when three bulged portions are formed, one at the center and two at both sides of the first one, the number of the fixed spaces may be one. When more than four bulged portions are to be formed, the central projection is made first, and then additional portions are bulged into variable spaces at the outer sides of those spaces already used to attain the necessary number of bulged portions having sufficient thickness.

Moreover, if preliminarily deformed recesses are made in advance at locations close to the position for bulging a middle projection, using press work or the like as mentioned above, the branch pipes are further guaranteed to have uniform thickness.

EFFECT

The first embodiment relates to a manufacturing method for a pipe with projections, characterized by deforming a pipe member to have recesses at areas near the position to form a projection. The method of this embodiment can bulge projections with evenly distributed thickness since a projection is formed with the sag which has been folded in advance.

The second embodiment relates to a manufacturing method for a pipe with branch pipes, characterized by using fixed spaces at the middle position and variable spaces positioned at the sides thereof. Since the method allows folding of excess material at locations where bulged portions are to be formed, with the pressure applied from both sides axially, branch pipes in a plural number, three or more, can be formed smoothly to have a uniform thickness. Three or more branch pipes used to present the problem of an insufficient bulging effect.

The method of the present invention is highly applicable to the production of parts having a large number of branch pipes, such as manifolds for automobiles.

What is claimed is:

1. A method for manufacturing a pipe with projections using an apparatus which includes a bulge mold having at least one fixed space at an axially middle position and having variable spaces at the sides of the at least one fixed space, detachable members detachably mounted in the variable spaces to fully occupy the variable spaces, and holding members which press a pipe member inside the bulge mold from both ends, said method comprising the steps of:

housing the pipe member in the bulge mold, with the detachable members being mounted in the variable spaces;

holding tightly the pipe member with the bulge mode;

introducing pressurized fluid into the pipe member and using the holding members to apply pressure on the pipe member toward the center thereof to bulge an intermediate portion thereof to form at least one projection;

removing the detachable members from the variable spaces after the at least one projection is formed; and introducing pressurized fluid into the pipe member and using the holding members to apply pressure on the pipe member toward center thereof to form bulged portions at positions closer to the ends of the pipe member.

2. The manufacturing method for a pipe with projections as claimed in claim 1, wherein the bulge mold has a cavity in which the pipe member is accommodated, wherein the fixed spaces and variable spaces have inlet ends adjacent the cavity and far ends which are spaced apart from the cavity, and wherein the steps of introducing pressurized fluid into the pipe member and using the holding members to apply pressure on the pipe member are conducted to form projections having curved surfaces at positions close to the inlets of the fixed spaces and variable spaces, the projections having cross sectional dimensions which are larger at positions close to the inlets of the fixed spaces and variable spaces than at positions close to the far ends of the fixed spaces and variable spaces.

3. The manufacturing method for a pipe with projections as claimed in claim 1, wherein the detachable members mounted in the variable spaces comprise columner members, and wherein the apparatus further includes hollow cylindrical members each having a closed end and an open end with an outwardly flared surface, and further comprising the step of inserting the hollow cylindrical detachable members in the variable spaces before conducting the step of introducing pressurized fluid into the pipe member and using the holding members to apply pressure on the pipe member toward the center thereof to form bulged portions closer to the end of the pipe member.

4. A method for manufacturing a pipe with projections, comprising the steps of:

(a) placing a pipe member in a bulge mold having a fixed recess and a variable recess;

(b) placing a detachable member in the variable recess, the detachable member having a surface which contacts the pipe member;

(c) immobilizing the detachable member;

(d) while the detachable member is immobilized, expanding the wall of the pipe member into the fixed recess with pressurized fluid;

(e) releasing the detachable member; and (f) expanding the wall of the pipe member into the variable recess with pressurized fluid.

5. The method of claim 4, further comprising forcing the ends of the pipe member toward each other during steps (d) and (f).

6. The method of claim 4, further comprising positioning a backstop adjacent the detachable member and at a position spaced apart from the detachable member after the detachable member is released in step (e), the backstop limiting movement of the detachable member when the wall of the pipe member is expanded into the variable recess in step (f).

7. The method of claim 4, wherein the variable recess and the detachable member have respective flared portions which lie adjacent the pipe member when the pipe member is in the mold, and wherein step (e) is conducted by opening the mold and removing the detachable member.

8. The method of claim 4, wherein step (e) comprises removing the detachable member, and further comprising the step of placing another detachable member in the variable recess, the another detachable member having a cavity with a flared mouth which faces the pipe member, and the step of immobilizing the another detachable member, and wherein step (f) is conducted by expanding the wall of the pipe member into the cavity of the another detachable member.

9. The method of claim 4, wherein the mold has a further fixed recess, the fixed recess and the further fixed recess being positioned adjacent one another, with the fixed recess being between the variable recess and the further fixed recess, and further comprising expanding the wall of the pipe member into the further fixed recess during step (d).

10. The method of claim 9, wherein the mold has a further variable recess adjacent the further fixed recess, the fixed recess and the further fixed recess being between the variable recess and the further variable recess, and further comprising expanding the wall of the pipe member into the further variable recess during step (f).

11. The method of claim 4, wherein the mold has a further variable recess, and further comprising expanding the wall of the pipe member in to the further variable recess after at least one prior expansion of the wall of the pipe member into a recess has been conducted.

* * * * *